US005382871A

United States Patent [19]

Funahashi et al.

[11] Patent Number: 5,382,871

[45] Date of Patent: Jan. 17, 1995

[54] COLOR SELECTING STRUCTURE FOR A CATHODE-RAY TUBE

[75] Inventors: Hiroko Funahashi, Aichi; Mitsuo Kato, Gifu; Hidemi Miyamura; Jun Yamazaki, both of Aichi, all of Japan

[73] Assignee: Sony Corporation, Tokyo, Japan

[21] Appl. No.: 234,629

[22] Filed: Apr. 28, 1994

Related U.S. Application Data

[63] Continuation of Ser. No. 963,849, Oct. 20, 1992, abandoned.

[30] Foreign Application Priority Data

Oct. 24, 1991 [JP] Japan ..... 3-277867

[51] Int. Cl.[6] ..... H01J 29/80

[52] U.S. Cl. ..... 313/402; 313/269; 313/407; 445/36; 445/37; 445/47

[58] Field of Search ..... 313/402, 269, 407; 445/36, 37, 47

[56] References Cited

U.S. PATENT DOCUMENTS

| | | | |
|---|---|---|---|
| 3,487,253 | 12/1969 | Scharmann | 313/269 |
| 3,638,063 | 1/1972 | Tachikawa et al. | 313/269 |
| 4,504,764 | 3/1985 | Sakamoto . | |
| 4,780,641 | 10/1988 | Hashiba et al. | 313/269 |

FOREIGN PATENT DOCUMENTS

| | | |
|---|---|---|
| 144246 | 6/1985 | European Pat. Off. . |
| 62-188133 | 8/1987 | Japan . |
| 1206544 | 8/1989 | Japan . |
| 1209276 | 10/1970 | United Kingdom . |
| 1240251 | 7/1971 | United Kingdom . |
| 2098392 | 11/1982 | United Kingdom . |

*Primary Examiner*—Michael Horabik
*Assistant Examiner*—Matthew J. Esserman
*Attorney, Agent, or Firm*—Jay H. Maioli

[57] ABSTRACT

A color selecting structure for a TRINITRON cathode-ray tube, in which color phosphor stripes are provided and a single electron gun emits three beams, capable of minimizing vertical fringes that deteriorate the quality of a picture displayed on the screen and of attenuating the vibration of a FAG (framing aperture grille plate), includes a thin plate having a plurality of tape-shaped grid (*2a*) elements and apertures (*2a*), and fine wires (3) extended across the surface of the aperture grille plate so as to apply a pressure in the range of $6.73\times10^{-6}$ lbf., $2.24\times10^{-5}$ lbf. to each grid element (*2a*).

2 Claims, 2 Drawing Sheets

COLOR SELECTING STRUCTURE FOR A CATHODE-RAY TUBE

This is a continuation of application Ser. No. 07/963,849 filed Oct. 20, 1992 abandoned.

BACKGROUND OF THE INVENTION

1. Field of the Invention

The present invention relates to a color selecting structure for a cathode-ray tube (CRT) and, more particularly, to damper wires (fine wires) extended on the tape surface of an aperture grille plate (AG) for a TRINITRON CRT, in which color phosphor stripes and provided and a single electron gun emits three beams, to prevent vibrations.

2. Description of the Prior Art

A TRINITRON CRT, in which color phosphor stripes are provided and a single electron gun emits three beams, uses, as a color selecting structure, a plurality of tape-shaped grid elements formed by a plurality of vertical apertures in a thin plate, such as a thin steel sheet, by an etching process and welded to a frame so as to extend tautly in a fixed tension. The thin plate, i.e., the etched thin plate, having the apertures, the plurality of tape-shaped grid elements and the framing elements is called a FAG (framing aperture grille plate). Electron beams pass through the apertures of the FAG and impinge on the fluorescent screen to make portions of the fluorescent screen luminous.

FIG. 2 is a perspective view of a FAG mounted on a frame, FIG. 3 is a sectional view taken on line I—I in FIG. 2, and FIG. 4 is an enlarged view of a portion of FIG. 2. Shown in FIGS. 2 to 4 are a frame 1, a FAG 2, tape-shaped grid elements 2*a*, apertures 2*b*, and two damper wires 3 extended perpendicularly to the apertures 2*b* to restrain the FAG from vibration, damper springs 4 fixedly holding the damper wires 3 on the frame 1. Usually, the damper wires 3 are tungsten wires of a diameter in the range of 10 to 30 μm. As shown in FIG. 4, the tape-shaped grid elements 2*a*, i.e., strips of a soft steel, are arranged in parallel to each other and vibrate like the strings of musical instruments according to the length and tension thereof. The vibration of the grid elements 2*a* disturbs the landing of electron beams on the fluorescent screen, disturbing images formed thereon. Therefore, the damper wires 3 are extended perpendicularly to the grid elements 2*a* to restrain the grid elements 2*a* from vibration.

Although the higher the tension of the damper wires, the greater is the effect of the damper wires on the attenuation of the vibration of the aperture grille AG, the high tension of the damper wires entails a new problem. If each tape-shaped grid element 2*a*, which is a strip of a soft steel, is dislocated from a correct position 7*a* to an incorrect position 7*b* as shown in FIG. 5 by heat or mechanical shock applied thereto, it is possible that the dislocated tape-shaped grid element 2*a* is held firmly at the incorrect position 7*b* and unable to restore itself to its correct position 7*a* when the tungsten wire is extended excessively tautly. If an aperture grille having dislocated grid elements is put on the screen of a CRT, vertical moiré fringes of fine pitches appear on the screen. These vertical moiré fringes become conspicuous particularly when the entire screen is white.

SUMMARY OF THE INVENTION

Accordingly, it is an object of the present invention to provide a color selecting structure for a TRINITRON cathode-ray tube, in which color phosphor stripes are provided and a single election gun emits three beams, capable of minimizing vertical moiré fringes that deteriorate the quality of the picture displayed on the screen and of attenuating the vibration of the FAG.

In one aspect of the present invention, a color selecting structure for a cathode-ray tube, comprises a thin aperture grille plate provided with a plurality of tape-shaped grid elements, and fine wires extended across the surface of the aperture grille plate substantially perpendicularly to the grid elements so as to apply a force in the range of $6.73\times10^{-6}$ lbf. to $2.24\times10^{-5}$ lbf. to each grid element, as measured by a precision spring balance.

The fine wires extended across the surface of the aperture grille so as to apply a predetermined pressure to each grid element appropriate to attenuating the vibration of the tape-shaped grid elements 2*a* of the aperture grille and to minimizing vertical moiré fringes formed on the screen to prevent the deterioration of the quality of pictures displayed on the screen.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
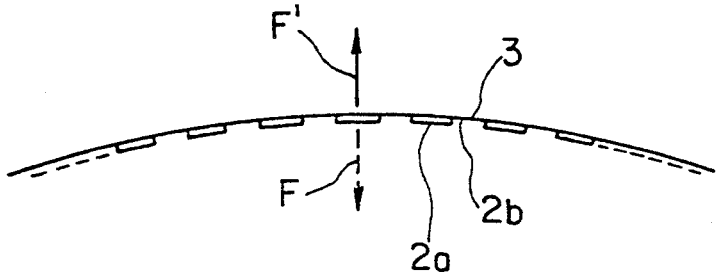
FIG. 1 is a diagrammatic view useful in explaining a normal reaction acting on each of the tape-shaped grid elements of a FAG when a damper wire is extended across the FAG.
Figure 2:
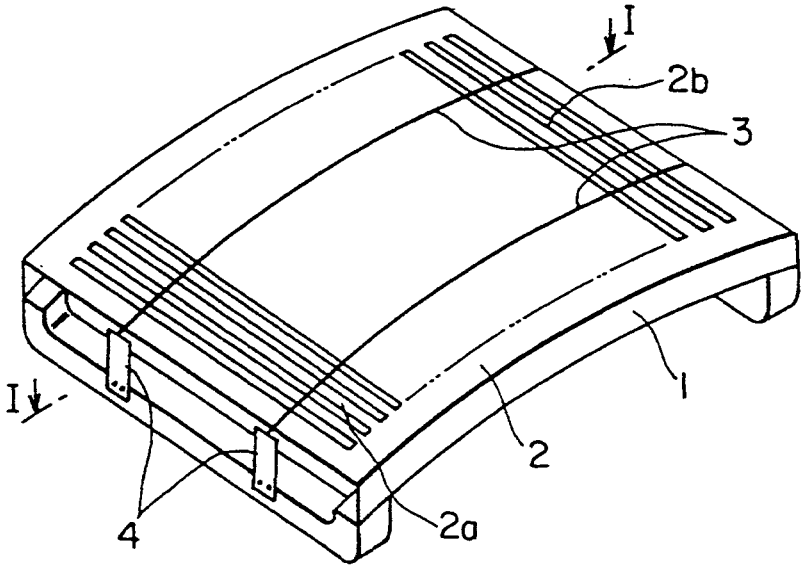
FIG. 2 is a perspective view of a FAG mounted on a frame.
Figure 3:
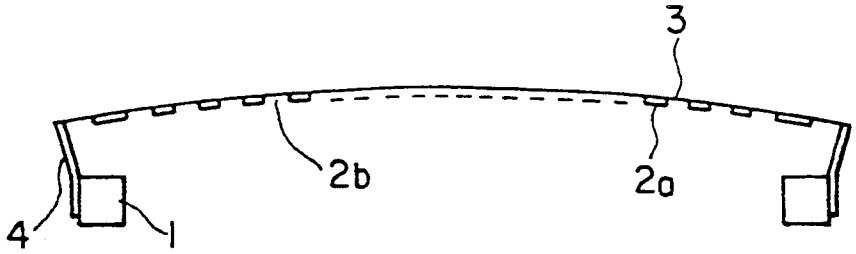
FIG. 3 is a sectional view taken on line I—I in FIG. 2.
Figure 4:
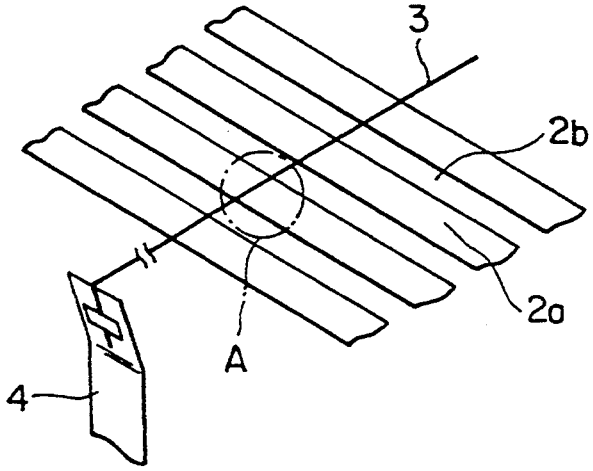
FIG. 4 is an enlarged view of a portion of FIG. 2.
Figure 5:
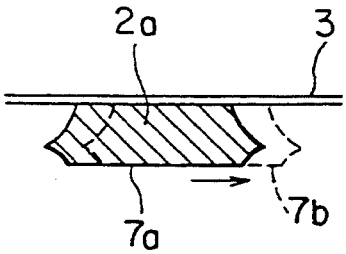
FIG. 5 is an enlarged sectional view of a portion A in FIG. 4.

FIG. 1 is a diagrammatic view showing a force acting on each tape-shaped grid element 2*a* of an aperture grille when damper wires are extended across the surface of the aperture grille. The force F′ is, as a matter of course, proportional to a tension F induced in each grid element 2*a*. In this embodiment, the effect of the force F′ applied by a damper wire 3 to each tape-shaped grid element 2*a* was tested, the results of which are shown in Table 1.

TABLE 1

| Test Nos. | F′ mg | Vibration | Vertical friges |
|---|---|---|---|
| 1 | 3 | Attenuated immediately | Faint |
| 2 | 6 | Attenuated immediately | Faint |
| 3 | 10 | Attenuated immediately | Faint |
| 4 | 2 | Continued 20 sec | None |
| 5 | 12 | Attenuated immediately | Conspicuous |

Note:
Test Nos. 1, 2 and 3 are for samples meeting the requirements of the present invention. Test Nos. 4 and 5 are for comparative samples. The force F′ was measured by a precision spring balance and is converted to pounds of force by multiplying the given value by $2.24224\times10^{-6}$ lbf./mg.

It is known from Table 1 that both effective attenuation of the vibration of the FAG and effective minimization of vertical moiré fringes on the screen can be achieved when the damper wires 3 are extended so that the force F′ acting on each of the tape-shaped grid elements 2*a* of the FAG is in the range of $6.73\times10^{-6}$ lbf. to $2.24\times10^{-5}$ lbf. was measured by a precision spring balance.

As is apparent from the foregoing description, the present invention minimizes the vertical moiré fringes and attenuates the vibration of the FAG quickly.

Although the invention has been described in its preferred form with a certain degree of particularity, it is clear that many changes and variations are possible therein. It is therefore to be understood that the present invention may be practiced otherwise than as specifically described herein without departing from the scope and spirit thereof.

What is claimed is:

1. A color selecting structure for a cathode-ray tube, comprising:

a thin aperture grille plate having a plurality of tape-shaped grid elements; and a plurality of fine wires extended across an outer surface of the aperture grille plate arranged perpendicular to an outer surface of each of the plurality of grid elements, said plurality of fine wires being tensioned to apply a force to each of the plurality of grid elements in the range of $6.73\times10^{-6}$ lbf. to $2.24\times10^{-5}$ lbf. to attenuate vibration of said grid elements.

2. A method of forming a color selecting structure for a cathode-ray tube, comprising the steps of:

forming a frame to surround a periphery of a screen of the cathode-ray tube;

attaching a thin aperture grille plate having a plurality of tape-shaped grid elements to said frame;

extending a plurality of fine wires across an outer surface of the aperture grille plate so as to be arranged perpendicular to an outer surface of each of the plurality of grid elements; and tensioning the plurality of fine wires to apply a force to each of the plurality of grid elements in the range of $6.73\times10^{-6}$ lbf. to $2.24\times10^{-5}$ lbf. to attenuate vibration of said grid elements.

* * * * *